US007662077B1

(12) United States Patent
Liu

(10) Patent No.: US 7,662,077 B1
(45) Date of Patent: Feb. 16, 2010

(54) AB/BACK BENCH SYSTEM

(76) Inventor: Ping Liu, No. 8, Oianyingfang Street, Taijuan, Shanxi (CN)

( * ) Notice: Subject to any disclaimer, the term of this patent is extended or adjusted under 35 U.S.C. 154(b) by 0 days.

(21) Appl. No.: 12/228,834

(22) Filed: Aug. 15, 2008

(51) Int. Cl.
*A63B 26/00* (2006.01)

(52) U.S. Cl. ..... 482/142

(58) Field of Classification Search ..... 482/142, 482/92–100, 551; D21/676, 686, 690
See application file for complete search history.

(56) References Cited

U.S. PATENT DOCUMENTS 5,190,513 A * 3/1993 Habing et al. ..... 482/145
D370,506 S * 6/1996 Clem ..... D21/687
7,322,911 B2 * 1/2008 Webber ..... 482/142

* cited by examiner

*Primary Examiner*—Lori Baker

(57) ABSTRACT

A platform has upper and lower surfaces with upper, lower and side edges. A primary support bar has upper and lower ends. The primary support has a linear major extent and an arcuate minor extent. A cylindrical rear cross bar is coupled to the minor extent. A secondary support bar has upper and lower ends. A cylindrical front cross bar is coupled to the secondary support bar adjacent to the platform. A hinge has an axis of rotation coupling the secondary support bar to the primary support bar. A supplemental support bar has upper and lower ends. The lower end is slidably received in the secondary support bar. Knee cylinders extends laterally with respect to the supplemental support bar adjacent to its upper end. A pair of instep cylinders is provided. A bar rotatably receives the instep cylinders. A foot hinge pivotably couples the small bar to the secondary support bar.

1 Claim, 12 Drawing Sheets

AB/BACK BENCH SYSTEM

BACKGROUND OF THE INVENTION

1. Field of the Invention

The present invention relates to an ab/back bench system and more particularly pertains to supporting a user while performing exercises for ab and back conditioning, the system being readily reconfigurable, all in a safe, convenient and economical manner.

2. Description of the Prior Art

The use of exercise equipment of known designs and configurations is known in the prior art. More specifically, exercise equipment of known designs and configurations previously devised and utilized for the purpose of facilitating exercise through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 7,322,911 issued Jan. 29, 2008 to Webber relates to an Exercise Bench.

While this devices fulfills its particular objectives and requirements, the aforementioned patent does not describe an ab/back bench system that allows for supporting a user while performing exercises for ab and back conditioning, the system being readily reconfigurable, all in a safe, convenient and economical manner.

In this respect, the ab/back bench system according to the present invention substantially departs from the conventional concepts and designs of the prior art, and in doing so provides an apparatus primarily developed for the purpose of supporting a user while performing exercises for ab and back conditioning, the system being readily reconfigurable, all in a safe, convenient and economical manner.

Therefore, it can be appreciated that there exists a continuing need for a new and improved ab/back bench system which can be used for supporting a user while performing exercises for ab and back conditioning, the system being readily reconfigurable, all in a safe, convenient and economical manner. In this regard, the present invention substantially fulfills this need.

SUMMARY OF THE INVENTION

In view of the foregoing disadvantages inherent in the known types of exercise equipment of known designs and configurations now present in the prior art, the present invention provides an improved ab/back bench system. As such, the general purpose of the present invention, which will be described subsequently in greater detail, is to provide a new and improved ab/back bench system and method which has all the advantages of the prior art and none of the disadvantages.

To attain this, the present invention essentially comprises an ab/back bench system. First provided is a platform. The platform is in a generally triangular manner. The platform has a padded upper surface. In this manner a user is received and supported. The platform has a parallel lower surface. The platform has a linear upper edge. The platform has an essentially semi-circular lower edge. The platform has angled, essentially linear side edges. The side edges are provided between the upper and lower edges. The platform has a common thickness. The platform has a maximum width. The maximum width is adjacent to the upper edge. The platform has a longitudinal axis. The longitudinal axis is provided centrally between the upper and lower edges. The longitudinal axis has a length. The maximum width is between 60 percent and 70 percent of the length of the longitudinal axis. The side edges form an angle. The angle is about 12 degrees with respect to the longitudinal axis.

A rigid hollow primary support bar is provided. The primary support bar has an upper end. The primary support bar has a lower end. The primary support bar has a linear major extent. The major extent is provided adjacent the upper end. The primary support bar has an arcuate minor extent. The minor extent is provided adjacent the lower end. The major extent has a length. The length of the major extent is about 10 percent greater than the longitudinal axis. The major extent has a upper surface. The major extent has a lower surface. The upper surface is coupled to the lower surface of the platform. The primary support bar has a square cross sectional configuration. Each side has a height. The height of each side is essentially equal to the thickness of the platform. The minor extent has a lower end. The minor extent has an upper end. The upper end of the minor extent is formed as an extension of the lower end of the major extent. A cylindrical rear cross bar is provided. The rear cross bar is coupled to the lower end of the minor extent adjacent to the lower end of the platform.

Provided next is a rigid hollow secondary support bar. The secondary support bar has an upper end. The secondary support bar has a lower end. The cross section size and shape of the secondary support bar are essentially the same as that of the primary support bar. The secondary support bar has an upper surface. The secondary support bar has a lower surface. The secondary support bar has a length. The length of the secondary support bar is between 70 percent and 90 percent of the length of the major extent of the primary support bar. A cylindrical front cross bar is provided. The front cross bar is coupled to the lower end of the secondary support bar adjacent to the upper end of the platform. The front and rear cross bars are positionable upon a recipient surface during operation and use of the system.

A hinge is provided next. The hinge has an axis of rotation. The hinge couples the upper end of the secondary support bar to the upper end of the primary support bar. In this manner movement is provided between an operative orientation and an inoperative orientation. The operative orientation features the secondary support bar adjacent to its upper end in proximity to the upper end of the primary support bar. The inoperative orientation features the secondary support bar parallel with and adjacent to the primary support bar. The inoperative orientation further features the axis of rotation spaced an equal distance from the upper ends of the primary and secondary support bars. The primary support bar has a lateral aperture. The lateral aperture is provided adjacent to the secondary support bar. The hinge has a spring loaded hinge finger. The hinge finger is provided adjacent to the upper end of the secondary support bar. The hinge finger has an interior end. The interior end of the hinge finger is positionable through the aperture. In this manner the primary and secondary support bars are fixed in the operative orientation. The finger has an exterior end. The exterior end is adapted to be pulled by a user. In this manner the finger is retracted from the aperture. Further in this manner the secondary support bar is allowed to be pivoted with respect to the primary support bar into the inoperative orientation.

A supplemental support bar is provided. The supplemental support bar has an upper end. The supplemental support bar has a lower end. The supplemental support bar has a cross section shape essentially the same as that of the secondary support bar. The size of the supplemental support bar allows the lower end of the supplemental support bar to be slidably received by the upper end of the secondary support bar. The supplemental support bar has a upper surface. The supplemental support bar has a lower surface. The supplemental support bar has aligned apertures. The apertures are provided on the upper surface. The lower surface of the secondary support bar has a spring loaded lengthening finger. The lengthening finger is provided adjacent to the upper end of the secondary support bar. The lengthening finger has an interior end. The interior end of the lengthening finger is positonable through a preselected one of the apertures. In this manner the length of the secondary and supplemental support bars is fixed. The lengthening finger has an exterior end. The exterior end of the lengthening finger is adapted to be pulled by a user. In this manner the finger is retracted from the apertures. Also in this manner the supplemental support bar is allowed to by slid with respect to the secondary support bar. Further in this manner the length of the secondary and supplemental support bars may be varied.

Further provided is a pair of outwardly extending knee cylinders. The knee cylinders are of a common diameter. The knee cylinders extend laterally from the supplemental support bar adjacent to its upper end. The knee cylinders have padded surfaces. In this manner a user's legs are received behind the knees.

Provided last is a pair of outwardly extending instep cylinders. The instep cylinders are of a common diameter. The diameter of the instep cylinders is less than the diameter of the knee cylinders. The knee cylinders have padded surfaces. In this manner a user's insteps are received. A small bar is provided. The small bar has an interior end. The small bar has an exterior end. The exterior end rotatably receives the instep cylinders. A foot hinge is provided. The foot hinge pivotably couples the small bar to the lower surface of the secondary support bar closer to its lower end than its upper end. In this manner the foot hinge may be moved between an inoperative orientation and an operative orientation. The inoperative orientation features the foot hinge in proximity to the secondary support bar. The operative orientation features the foot hinge perpendicular to the secondary support bar.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved ab/back bench system which has all of the advantages of the prior art exercise equipment of known designs and configurations and none of the disadvantages.

It is another object of the present invention to provide a new and improved ab/back bench system which may be easily and efficiently manufactured and marketed.

It is further object of the present invention to provide a new and improved ab/back bench system which is of durable and reliable constructions.

An even further object of the present invention is to provide a new and improved ab/back bench system which is susceptible of a low cost of manufacture with regard to both materials and labor, and which accordingly is then susceptible of low prices of sale to the consuming public, thereby making such ab/back bench system economically available to the buying public.

Even still another object of the present invention is to provide an ab/back bench system for supporting a user while performing exercises for ab and back conditioning, the system being readily reconfigurable, all in a safe, convenient and economical manner.

Lastly, it is an object of the present invention to provide a new and improved ab/back bench system. A platform has upper and lower surfaces with upper, lower and side edges. A primary support bar has upper and lower ends. The primary support has a linear major extent and an arcuate minor extent. A cylindrical rear cross bar is coupled to the minor extent. A secondary support bar has upper and lower ends. A cylindrical front cross bar is coupled to the secondary support bar adjacent to the platform. A hinge has an axis of rotation coupling the secondary support bar to the primary support bar. A supplemental support bar has upper and lower ends. The lower end is slidably received in the secondary support bar. Knee cylinders extends laterally with respect to the supplemental support bar adjacent to its upper end. A pair of instep cylinders is provided. A bar rotatably receives the instep cylinders. A foot hinge pivotably couples the small bar to the secondary support bar.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
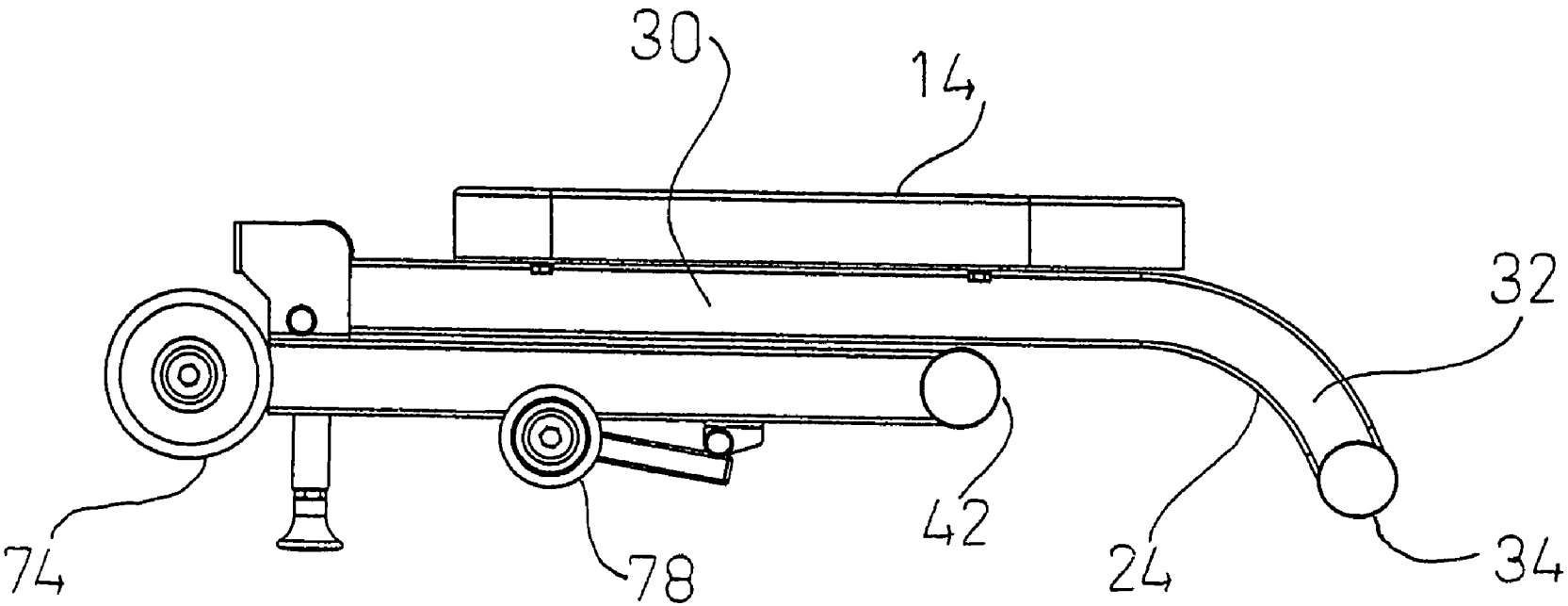
FIG. 1 is a perspective showing of an ab/back bench system constructed in accordance with the principles of the invention.
Figure 2:
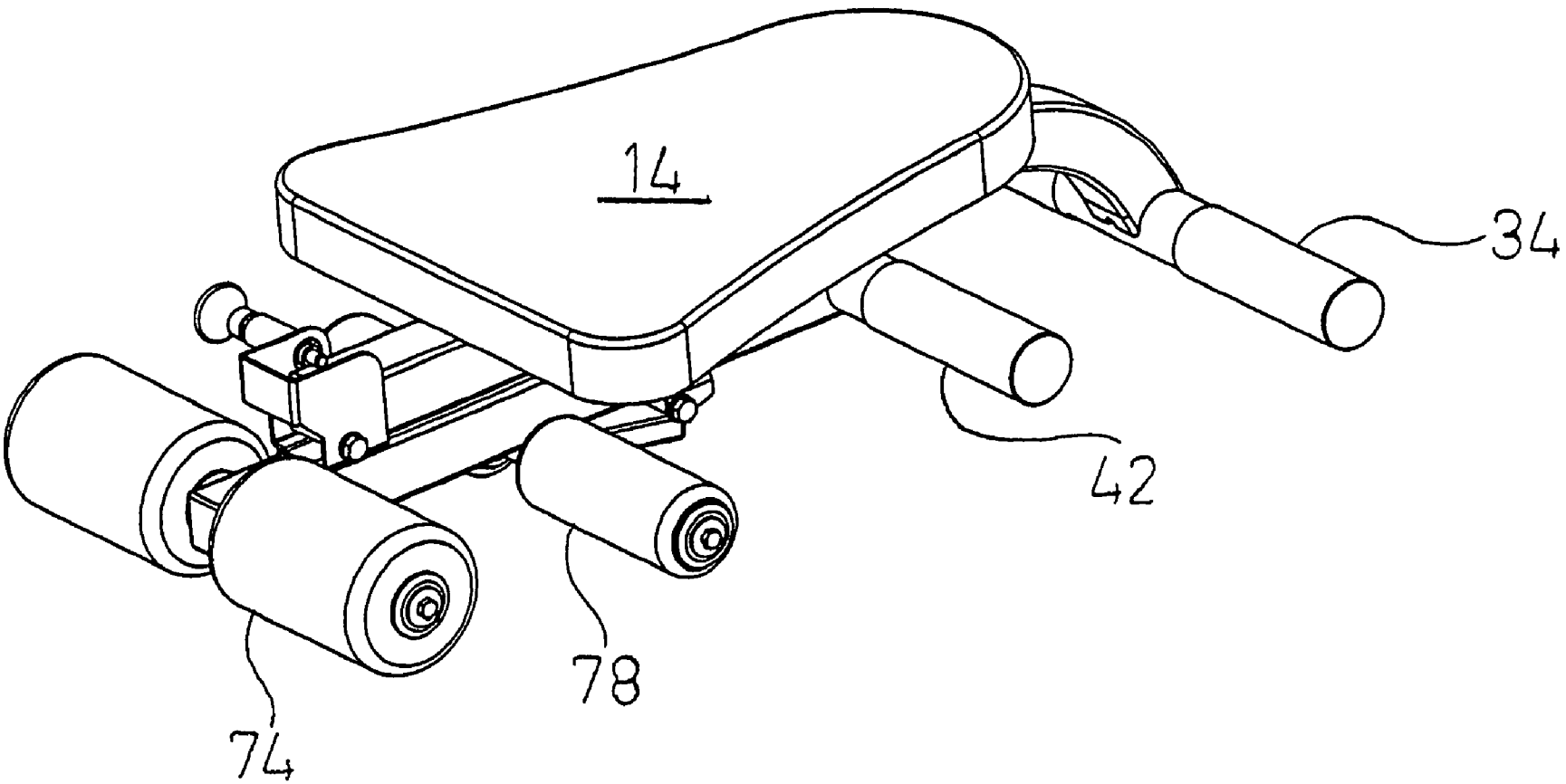
FIG. 2 is a front elevational view of the system shown in FIG. 1.
Figure 3:
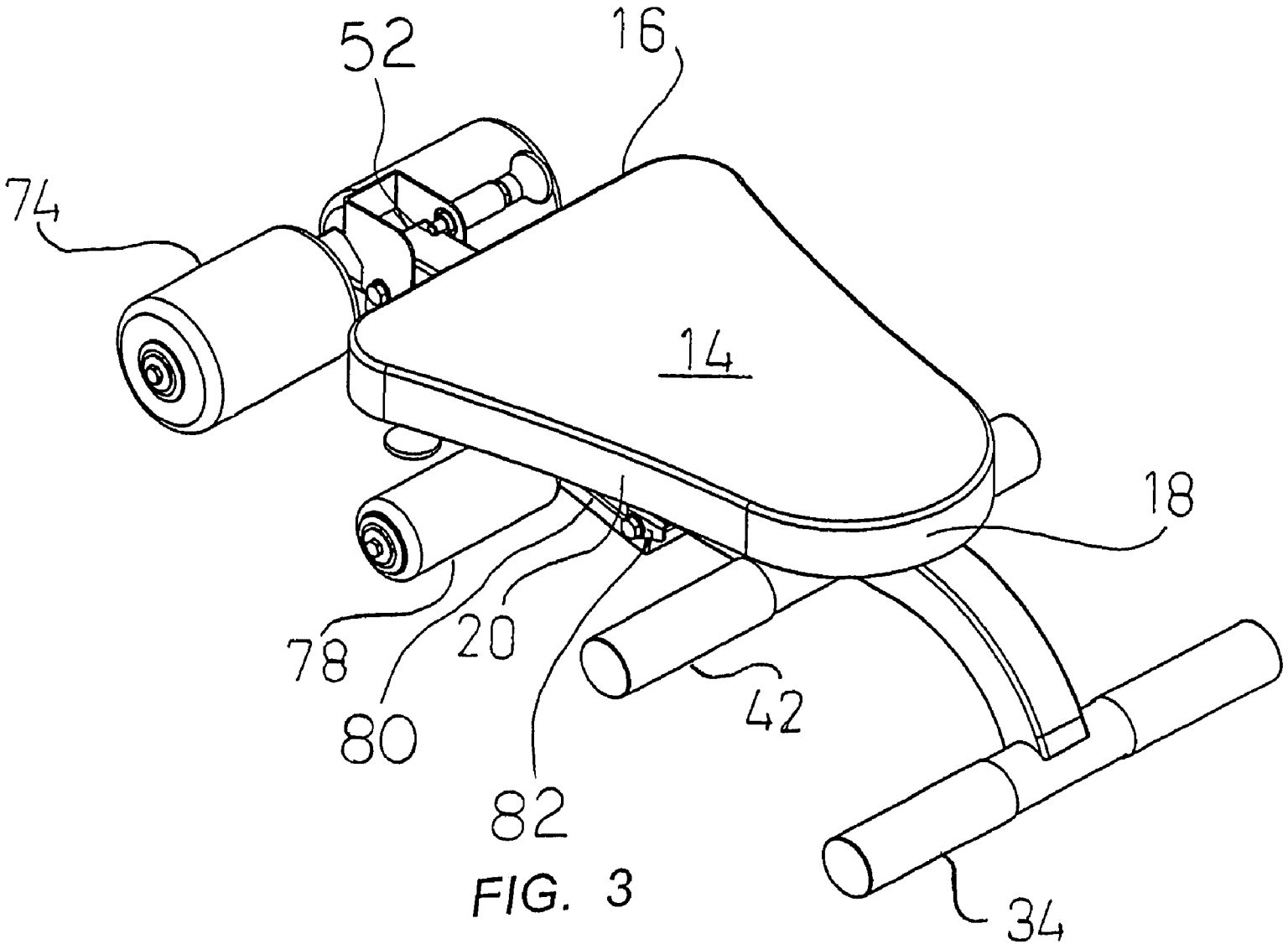
FIGS. 3 and 4 are side elevational views, partly in cross section, of the system shown in FIGS. 1 and 2.
Figure 4:
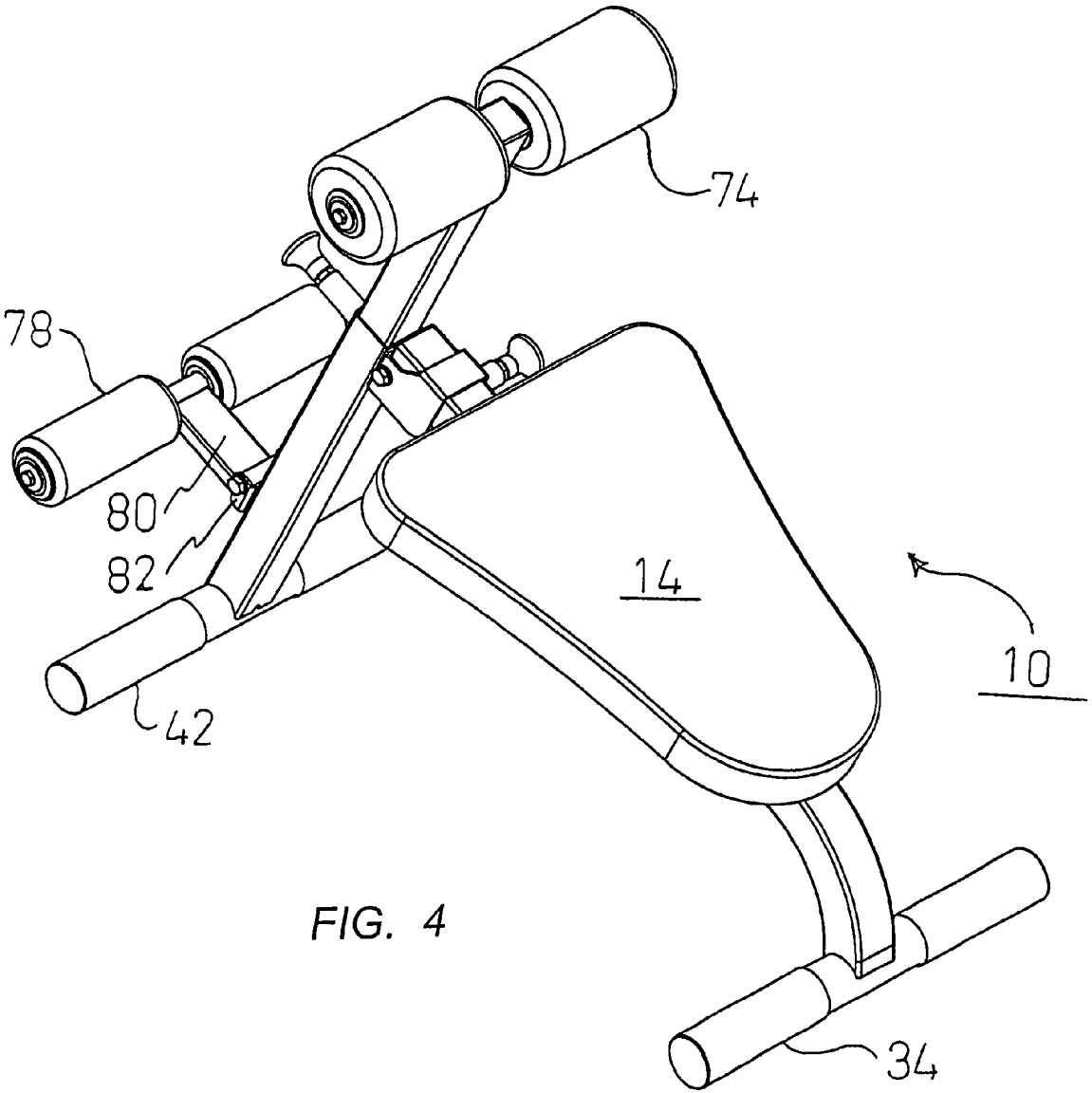
Figure 5:
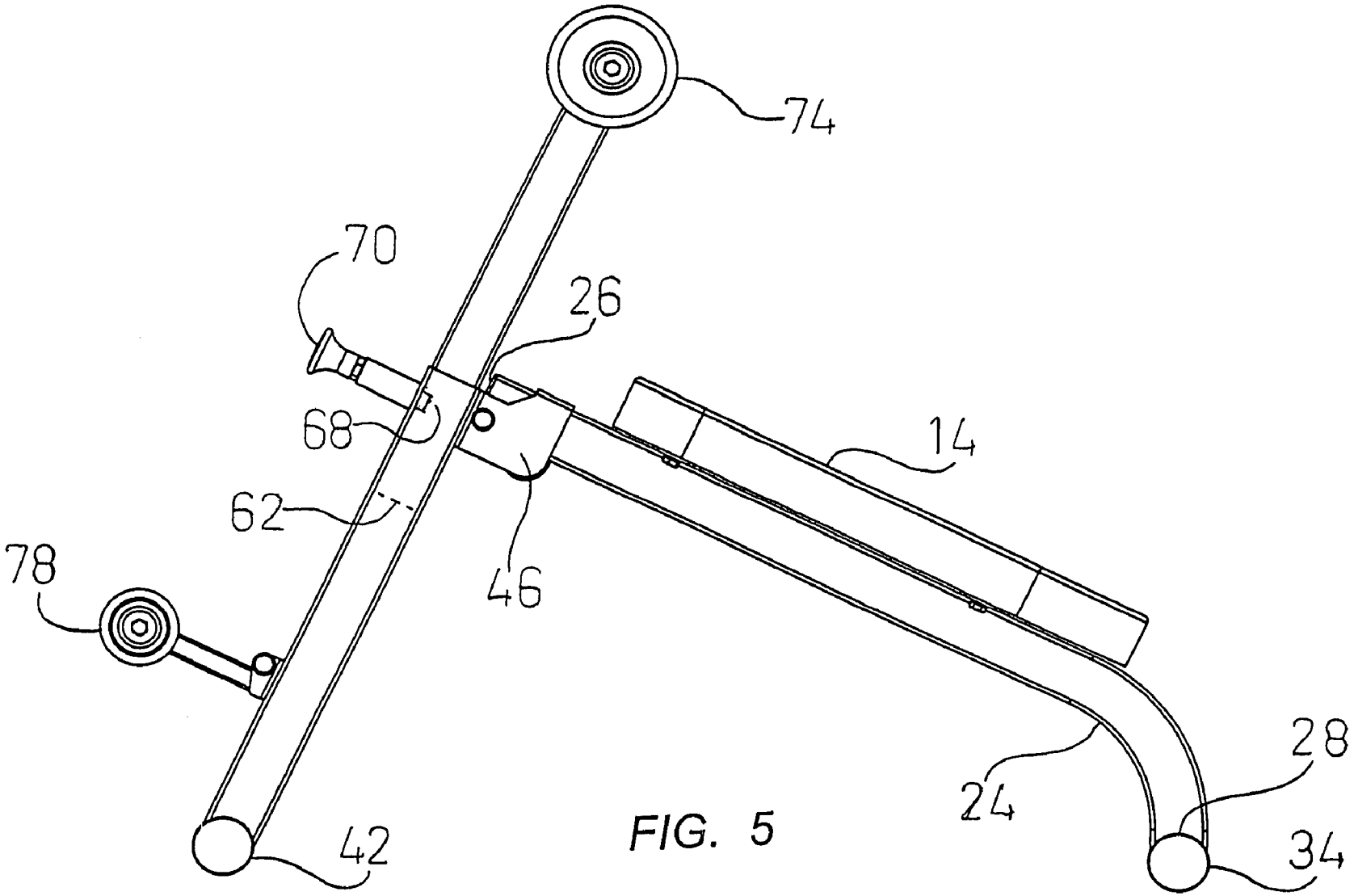
FIGS. 5, 6 and 7 are plan, rear and bottom views of the system shown in the prior Figures.
Figure 6:
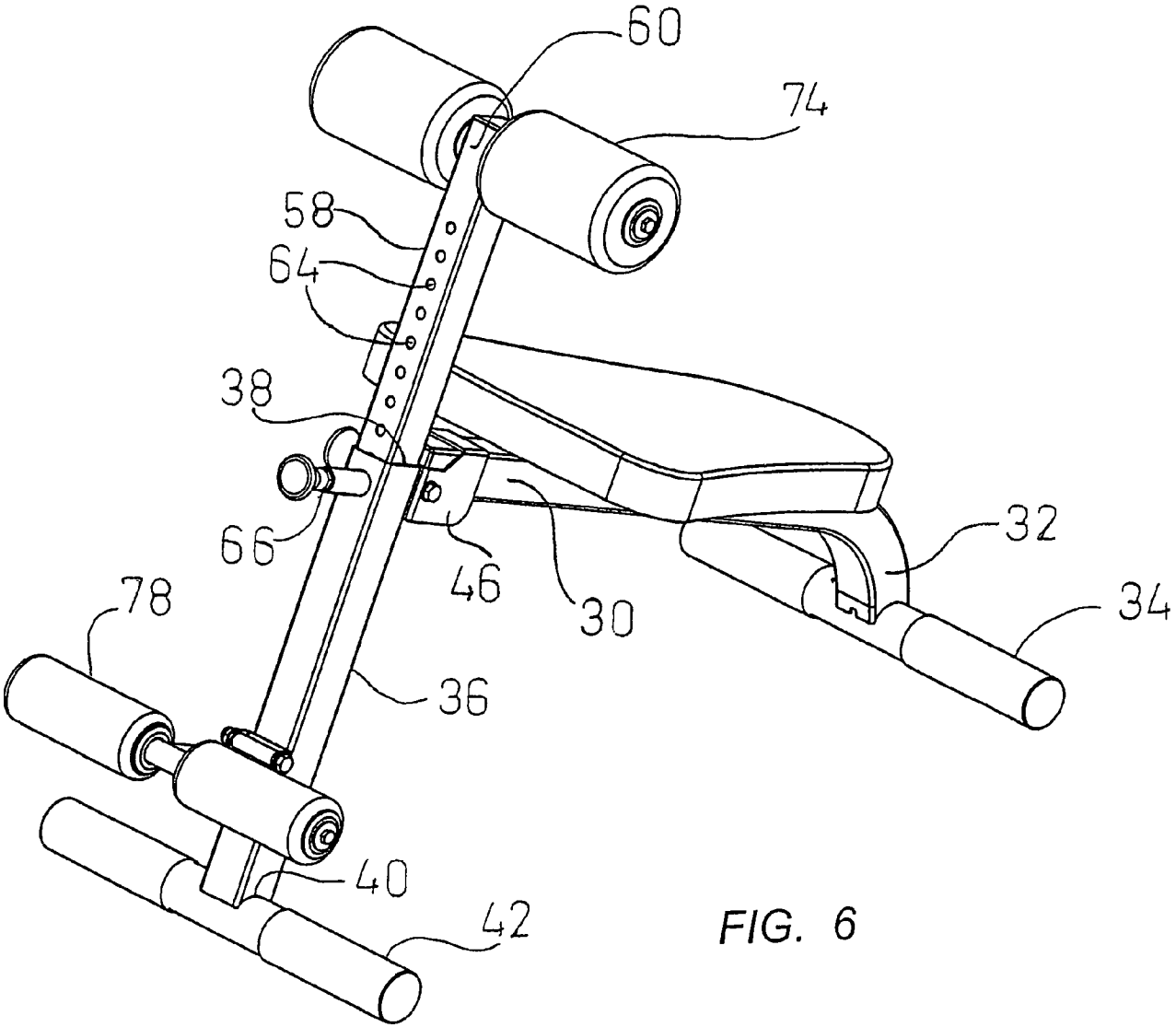
Figure 7:
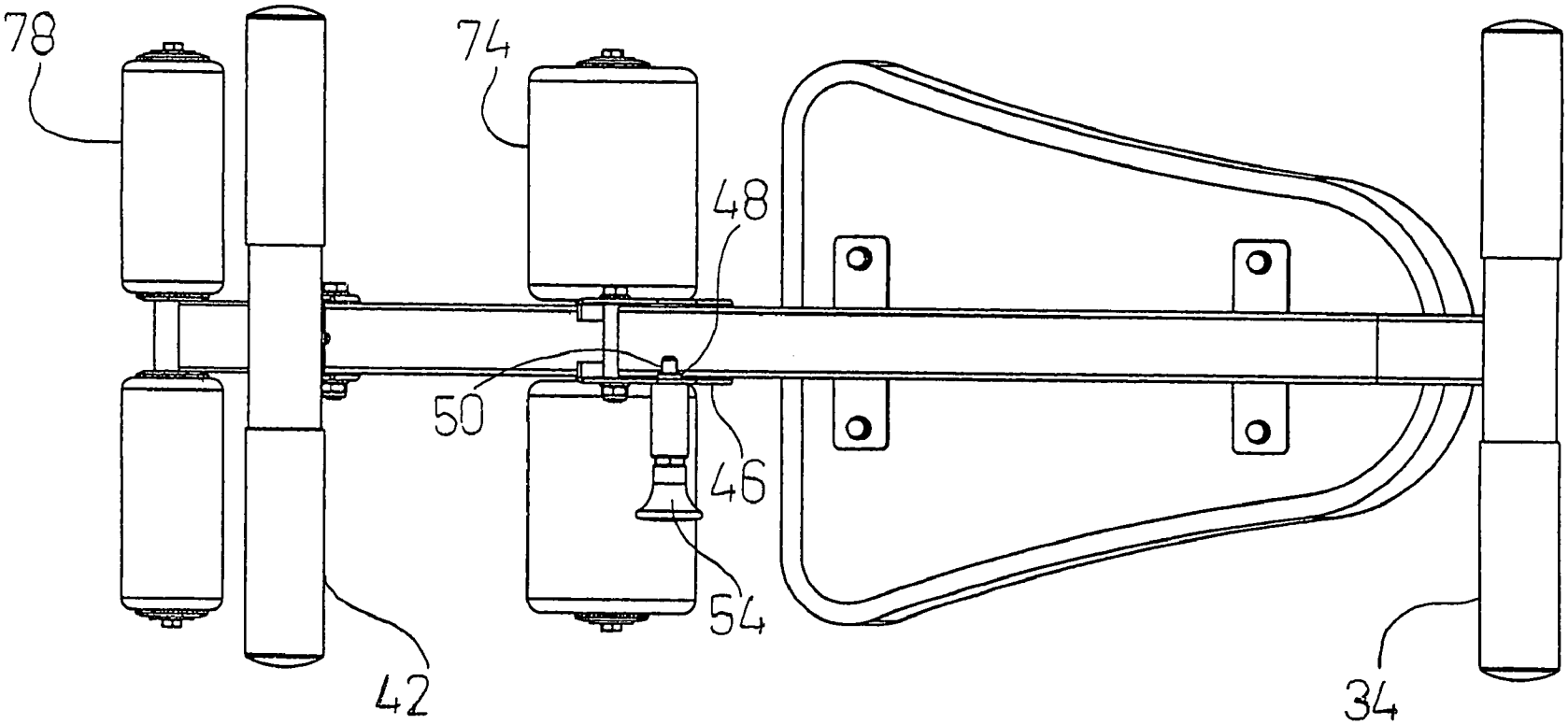
Figure 8:
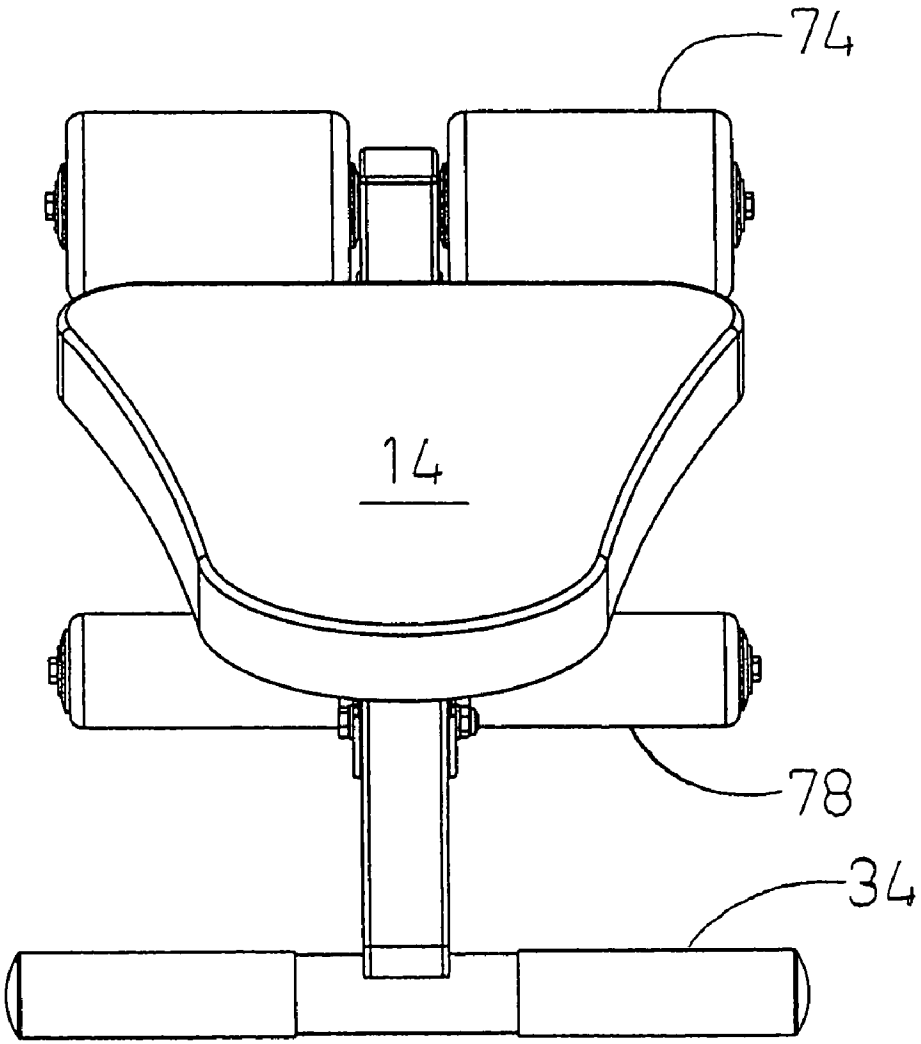
FIG. 8 is a perspective illustration of the ab/back bench system similar to FIG. 1 but with the supplemental support bar in an elevated orientation.
Figure 9:
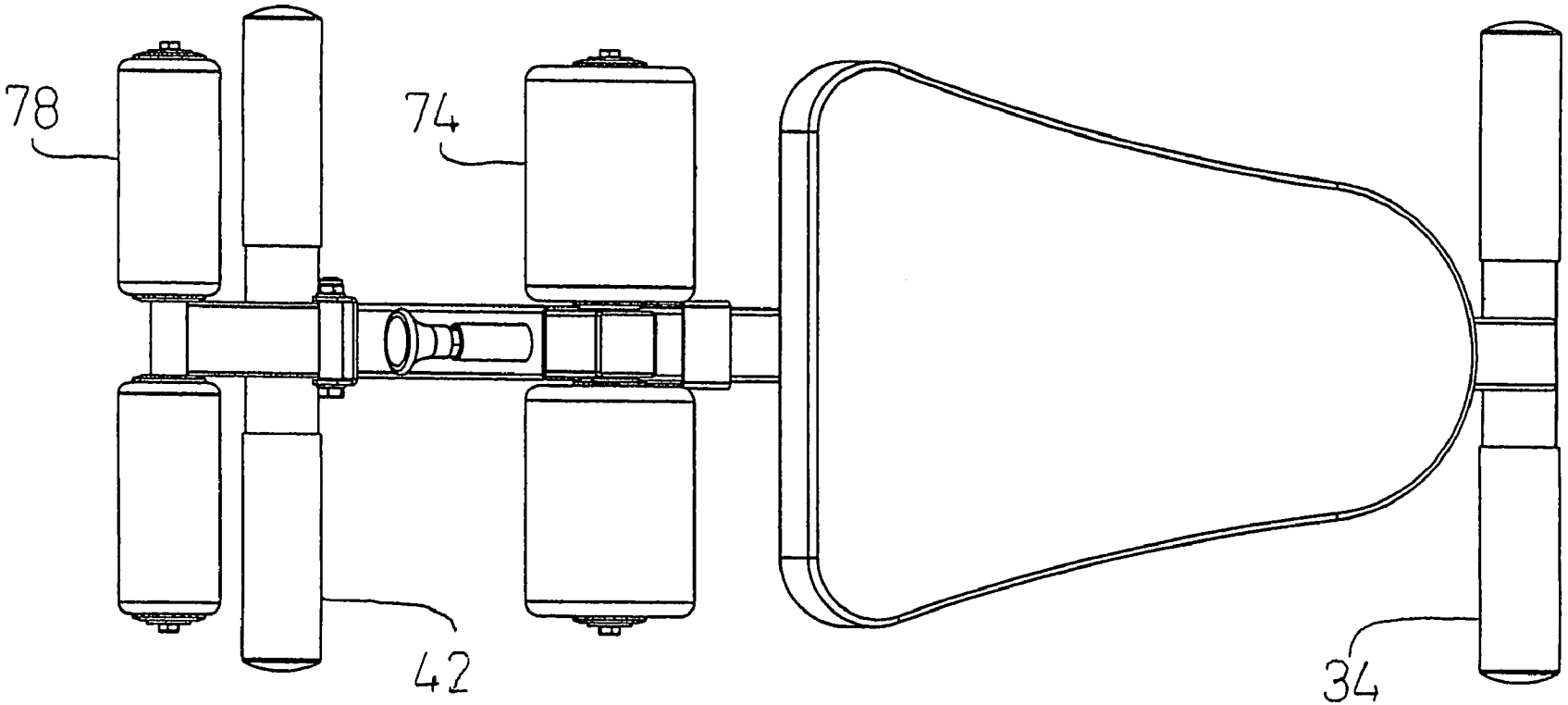
FIG. 9 is side elevational views, partly in cross section, similar to FIG. 3 but with the supplemental support bar in an elevated orientation.
Figure 10:
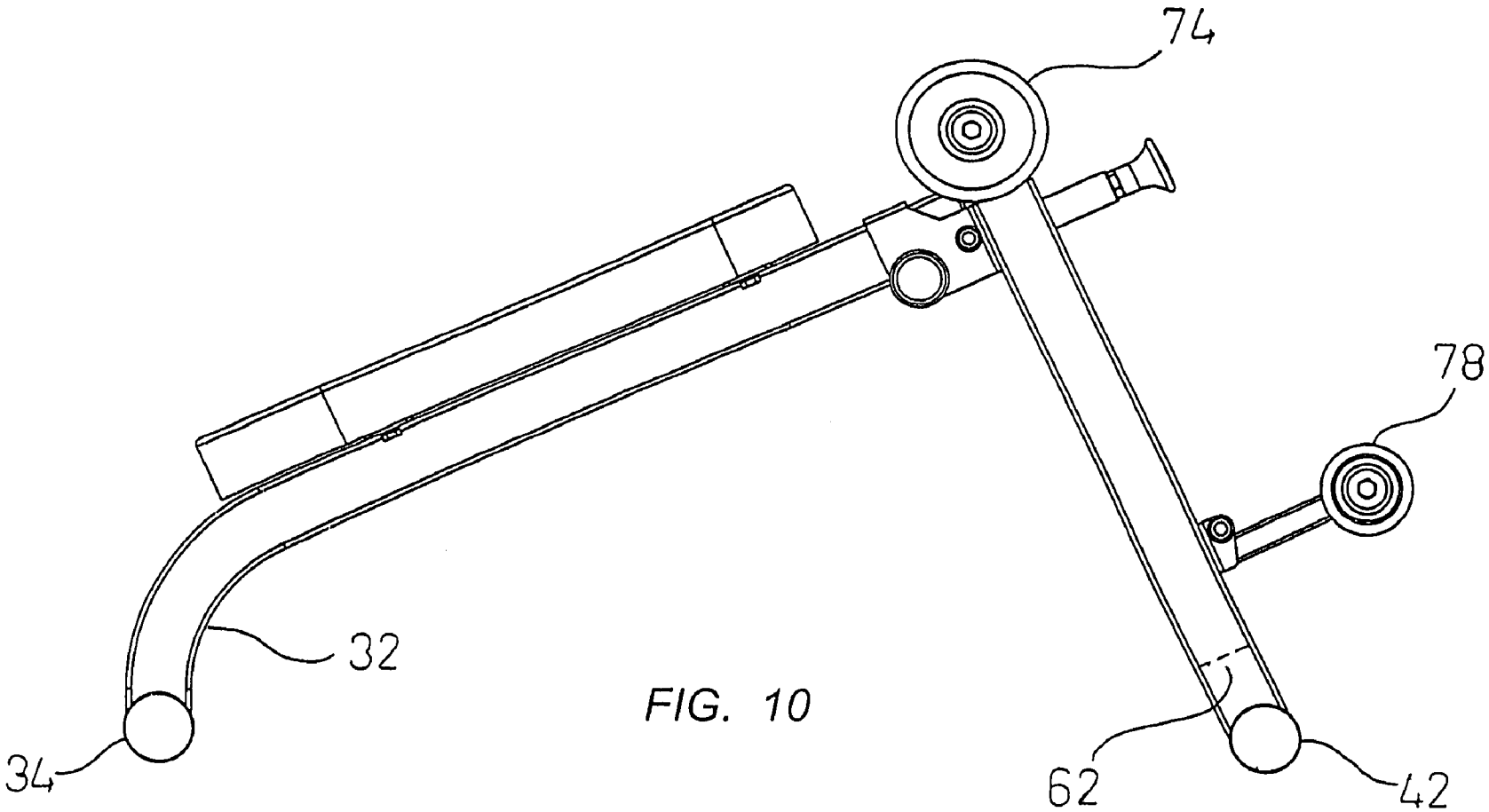
FIG. 10 is a perspective illustration with the supplemental support bar in an elevated orientation.
Figure 11:
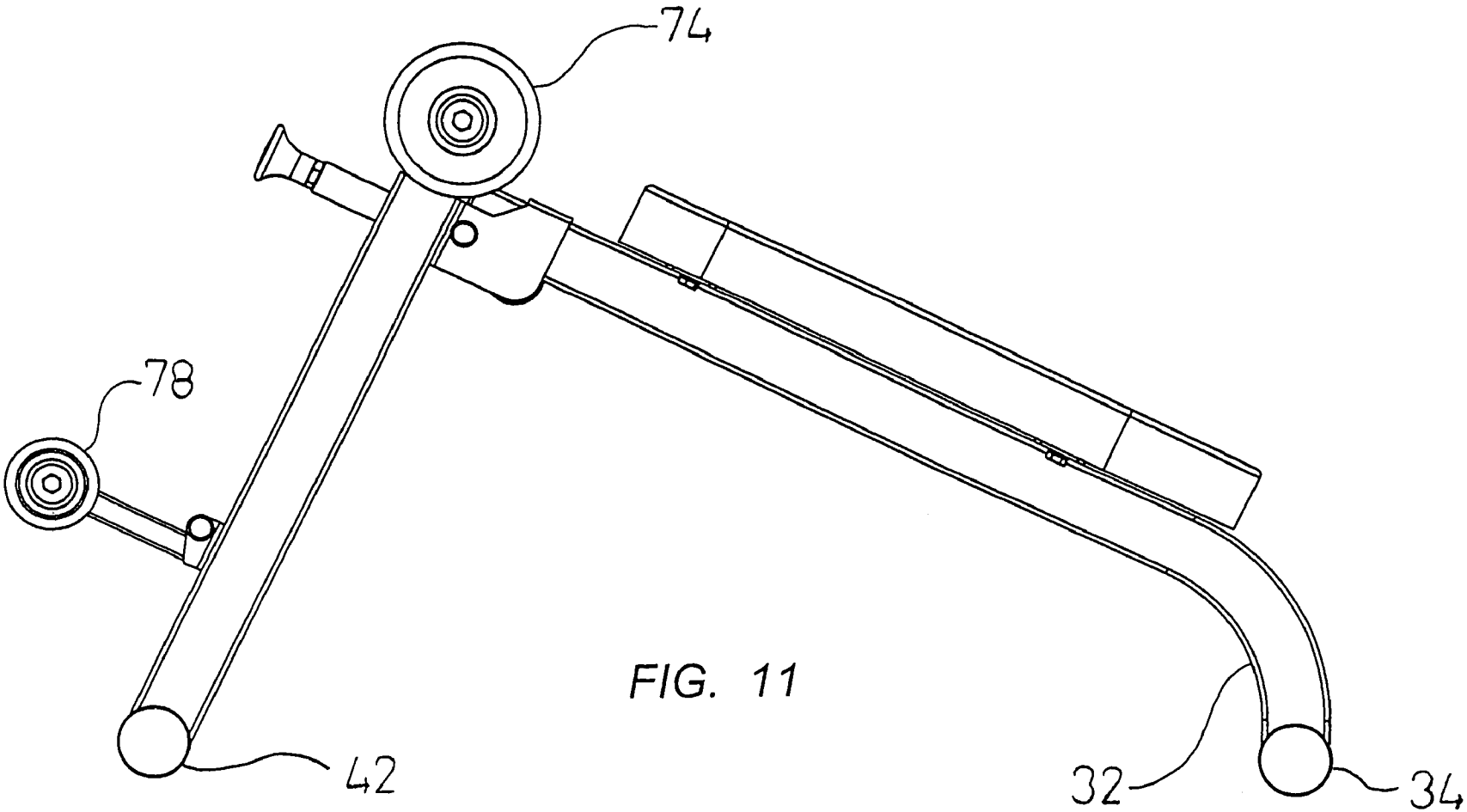
FIGS. 11 and 12 are perspective illustrations with the system in a collapsed, inoperative orientation.
Figure 12:
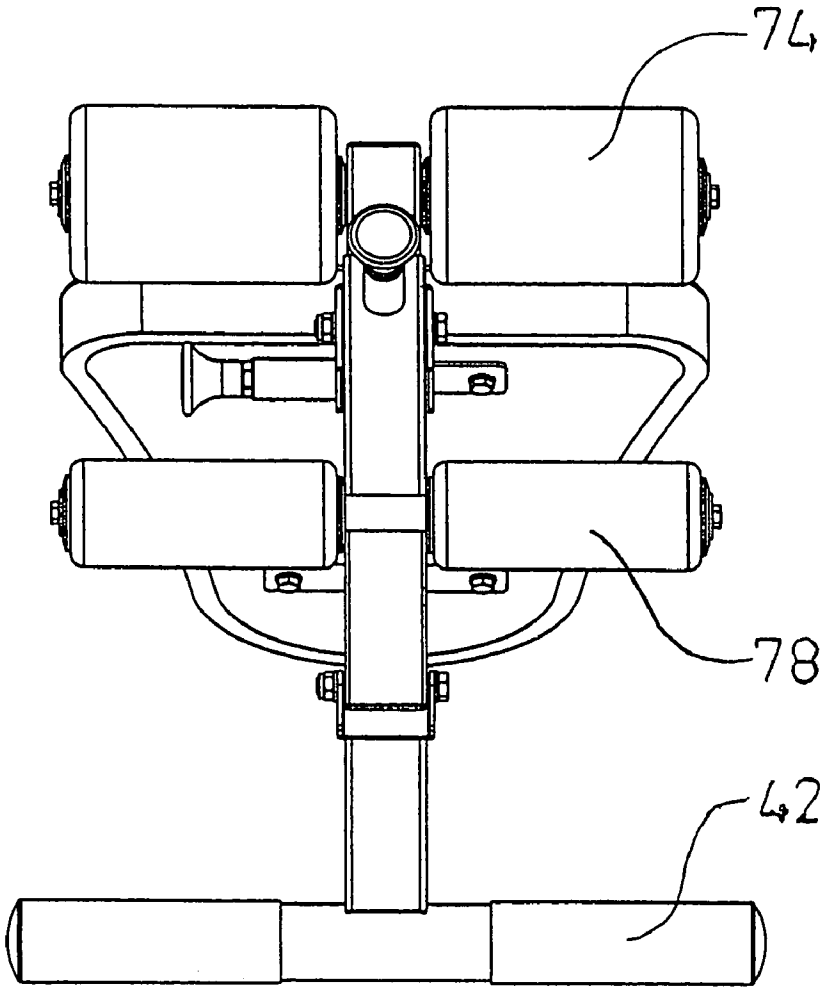

With reference now to the drawings, and in particular to FIG. 1 thereof, the preferred embodiment of the new and improved ab/back bench system embodying the principles and concepts of the present invention and generally designated by the reference numeral 10 will be described.

The present invention, the ab/back bench system 10 is comprised of a plurality of components. Such components in their broadest context include a platform, a primary support bar, a secondary support bar, a hinge, a supplemental support bar, a pair of knee cylinders and a pair of instep cylinders. Such components are individually configured and correlated with respect to each other so as to attain the desired objective.

First provided is a platform 14. The platform is in a generally triangular manner. The platform has a padded upper surface. In this manner a user is received and supported. The platform has a parallel lower surface. The platform has a linear upper edge 16. The platform has an essentially semicircular lower edge 18. The platform has angled, essentially linear side edges 20. The side edges are provided between the upper and lower edges. The platform has a common thickness. The platform has a maximum width. The maximum width is adjacent to the upper edge. The platform has a longitudinal axis. The longitudinal axis is provided centrally between the upper and lower edges. The longitudinal axis has a length. The maximum width is between 60 percent and 70 percent of the length of the longitudinal axis. The side edges form an angle. The angle is about 12 degrees with respect to the longitudinal axis.

A rigid hollow primary support bar 24 is provided. The primary support bar has an upper end 26. The primary support bar has a lower end 28. The primary support bar has a linear major extent 30. The major extent is provided adjacent the upper end. The primary support bar has an arcuate minor extent 32. The minor extent is provided adjacent the lower end. The major extent has a length. The length of the major extent is about 10 percent greater than the longitudinal axis. The major extent has a upper surface. The major extent has a lower surface. The upper surface is coupled to the lower surface of the platform. The primary support bar has a square cross sectional configuration. Each side has a height. The height of each side is essentially equal to the thickness of the platform. The minor extent has a lower end. The minor extent has an upper end. The upper end of the minor extent is formed as an extension of the lower end of the major extent. A cylindrical rear cross bar 34 is provided. The rear cross bar is coupled to the lower end of the minor extent adjacent to the lower end of the platform.

Provided next is a rigid hollow secondary support bar 36. The secondary support bar has an upper end 38. The secondary support bar has a lower end 40. The cross section size and shape of the secondary support bar are essentially the same as that of the primary support bar. The secondary support bar has an upper surface. The secondary support bar has a lower surface. The secondary support bar has a length. The length of the secondary support bar is between 70 percent and 90 percent of the length of the major extent of the primary support bar. A cylindrical front cross bar 42 is provided. The front cross bar is coupled to the lower end of the secondary support bar adjacent to the upper end of the platform. The front and rear cross bars are positionable upon a recipient surface during operation and use of the system.

A hinge 46 is provided next. The hinge has an axis of rotation. The hinge couples the upper end of the secondary support bar to the upper end of the primary support bar. In this manner movement is provided between an operative orientation and an inoperative orientation. The operative orientation features the secondary support bar adjacent to its upper end in proximity to the upper end of the primary support bar. The inoperative orientation features the secondary support bar parallel with and adjacent to the primary support bar. The inoperative orientation further features the axis of rotation spaced an equal distance from the upper ends of the primary and secondary support bars. The primary support bar has a lateral aperture 48. The lateral aperture is provided adjacent to the secondary support bar. The hinge has a spring loaded hinge finger 50. The hinge finger is provided adjacent to the upper end of the secondary support bar. The hinge finger has an interior end 52. The interior end of the hinge finger is positionable through the aperture. In this manner the primary and secondary support bars are fixed in the operative orientation. The finger has an exterior end 54. The exterior end is adapted to be pulled by a user. In this manner the finger is retracted from the aperture. Further in this manner the secondary support bar is allowed to be pivoted with respect to the primary support bar into the inoperative orientation.

A supplemental support bar 58 is provided. The supplemental support bar has an upper end 60. The supplemental support bar has a lower end 62. The supplemental support bar has a cross section shape essentially the same as that of the secondary support bar. The size of the supplemental support bar allows the lower end of the supplemental support bar to be slidably received by the upper end of the secondary support bar. The supplemental support bar has a upper surface. The supplemental support bar has a lower surface. The supplemental support bar has aligned apertures 64. The apertures are provided on the upper surface. The lower surface of the secondary support bar has a spring loaded lengthening finger 66. The lengthening finger is provided adjacent to the upper end of the secondary support bar. The lengthening finger has an interior end 68. The interior end of the lengthening finger is positonable through a preselected one of the apertures. In this manner the length of the secondary and supplemental support bars is fixed. The lengthening finger has an exterior end 70. The exterior end of the lengthening finger is adapted to be pulled by a user. In this manner the finger is retracted from the apertures. Also in this manner the supplemental support bar is allowed to by slid with respect to the secondary support bar. Further in this manner the length of the secondary and supplemental support bars may be varied.

Further provided is a pair of outwardly extending knee cylinders 74. The knee cylinders are of a common diameter. The knee cylinders extend laterally from the supplemental support bar adjacent to its upper end. The knee cylinders have padded surfaces. In this manner a user's legs are received behind the knees.

Provided last is a pair of outwardly extending instep cylinders 78. The instep cylinders are of a common diameter. The diameter of the instep cylinders is less than the diameter of the knee cylinders. The knee cylinders have padded surfaces. In this manner a user's insteps are received. A small bar 80 is provided. The small bar has an interior end. The small bar has an exterior end. The exterior end rotatably receives the instep cylinders. A foot hinge 82 is provided. The foot hinge pivotably couples the small bar to the lower surface of the secondary support bar closer to its lower end than its upper end. In this manner the foot hinge may be moved between an inoperative orientation and an operative orientation. The inoperative orientation features the foot hinge in proximity to the secondary support bar. The operative orientation features the foot hinge perpendicular to the secondary support bar.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An ab/back bench system for supporting a user while performing exercises for ab and back conditioning, the system, in combination, consisting of:

a platform in a generally triangular manner having a padded upper surface for receiving and supporting a user and a parallel lower surface, the platform having a linear upper edge and an essentially semi-circular lower edge with angled, essentially linear side edges between the upper and lower edges, the platform having a common thickness with a maximum width adjacent to the upper edge and with a longitudinal axis centrally between the upper and lower edges, the longitudinal axis having a length, the maximum width being between 60 percent and 70 percent of the length of the longitudinal axis, the side edges forming an angle of about 12 degrees with respect to the longitudinal axis;

a rigid hollow primary support bar having an upper end and a lower end with a linear major extent adjacent the upper end and an arcuate minor extent adjacent the lower end, the major extent having a length about 10 percent greater than the longitudinal axis, the major extent having a upper surface and a lower surface with the upper surface coupled to the lower surface of the platform, the primary support bar having a square cross sectional configuration with each side having a height essentially equal to the thickness of the platform, the minor extent having a lower end and an upper end formed as an extension of the lower end of the major extent, a cylindrical rear cross bar coupled to the lower end of the minor extent adjacent to the lower end of the platform;

a rigid hollow secondary support bar having an upper end and a lower end with cross section size and shape essentially the same as that of the primary support bar, the secondary support bar having a upper exterior surface and a lower interior surface, the secondary support bar having a length between 70 percent and 90 percent of the length of the major extent of the primary support bar, a cylindrical front cross bar coupled to the lower end of the secondary support bar adjacent to the upper end of the platform, the front and rear cross bars positionable upon a recipient surface during operation and use of the system;

a hinge with an axis of rotation through the primary support bar coupling the upper end of the secondary support bar to the upper end of the primary support bar for movement between an operative orientation and an inoperative orientation, the operative orientation featuring the secondary support bar adjacent to its upper end in proximity to the upper end of the primary support bar, the inoperative orientation featuring the secondary support bar parallel with and adjacent to the primary support bar along its entire length and with the axis of rotation spaced an equal distance from the upper ends of the primary and secondary support bars, a lateral aperture through primary support bar adjacent to the secondary support bar, a spring loaded hinge finger on the hinge adjacent to the upper end of the secondary support bar, the hinge finger having an interior end positionable through the aperture for fixing the primary and secondary support bars in the operative orientation, the finger having an exterior end adapted to be pulled by a user to retract the finger from the aperture and thereby allowing the secondary support bar to be pivoted with respect to the primary support bar into the inoperative orientation;

a supplemental support bar having an upper end and a lower end with a cross section shape essentially the same as that of the secondary support bar and a size for allowing the lower end of the supplemental support bar to be slidably received by the upper end of the secondary support bar, the supplemental support bar having an upper surface and a lower surface with aligned apertures on the upper surface, a spring loaded lengthening finger on the lower surface of the secondary support bar adjacent to the upper end of the upper exterior surface of the secondary support bar, the lengthening finger having an interior end positonable through a preselected one of the apertures for fixing the length of the secondary and supplemental support bars, the lengthening finger having an exterior end adapted to be pulled by a user to retract the finger from the apertures and thereby allowing the supplemental support bar to by slid with respect to the secondary support bar to thereby vary the length of the secondary and supplemental support bars;

a pair of outwardly extending knee cylinders of a common diameter and extending laterally from the supplemental support bar adjacent to its upper end, the knee cylinders having padded surfaces for receiving a user's legs behind the knees; and a pair of outwardly extending instep cylinders of a common diameter less than the diameter of the knee cylinders, the knee cylinders having padded surfaces for receiving a user's insteps, a small bar having an interior end and an exterior end and a central plate between the interior and exterior ends, the exterior end rotatably receiving the instep cylinders, and a foot hinge pivotably coupling the interior end of the small bar to the upper exterior surface of the secondary support bar closer to its lower end than its upper end for movement between an inoperative orientation with the central plate in proximity to and facing the upper exterior surface of the secondary support bar and an operative orientation perpendicular to the secondary support bar.

* * * * *